United States Patent [19]

Matas Gabalda

[11] Patent Number: 4,765,562

[45] Date of Patent: Aug. 23, 1988

[54] DEVICE FOR POSITIONING AND HOLDING A YARN SUPPORT TUBE DURING AN OPERATION OF UNWINDING OR WINDING

[75] Inventor: Carlos Matas Gabalda, Grange-les-Valence, France

[73] Assignee: IC-ACBF, Valence, France

[21] Appl. No.: 55,259

[22] Filed: May 29, 1987

[30] Foreign Application Priority Data

Jun. 19, 1986 [FR] France ..... 86 09053

[51] Int. Cl.[4] ..... B65H 49/20

[52] U.S. Cl. ..... 242/130; 242/46.4; 242/46.6

[58] Field of Search ..... 242/130, 130.1, 131, 242/131.1, 129.5, 129.7, 129.71, 46.6, 46.2, 46.3, 46.4, 72, 72.1, 73

[56] References Cited

U.S. PATENT DOCUMENTS

| | | | |
|---|---|---|---|
| 1,996,319 | 4/1935 | Blair | 242/46.3 X |
| 2,292,832 | 8/1942 | Grauer | 242/46.6 |
| 2,615,652 | 10/1952 | Johnson | 242/130 |
| 2,746,689 | 5/1956 | Berkepeis | 242/46.3 |
| 3,165,279 | 1/1965 | Remington | 242/130 |
| 3,356,309 | 12/1967 | Poteat | 242/46.6 |
| 3,398,907 | 8/1968 | Heumann | 242/46.4 |
| 3,592,401 | 7/1971 | Smith et al. | 242/46.3 |
| 3,850,394 | 11/1974 | Raasch et al. | 242/130 |
| 4,142,690 | 3/1979 | Karle et al. | 242/46.4 |
| 4,613,092 | 9/1986 | Nakai | 242/46.4 |

FOREIGN PATENT DOCUMENTS

| | | |
|---|---|---|
| 0078978 | 5/1983 | European Pat. Off. . |
| 1031156 | 3/1953 | France . |
| 2572374 | 5/1986 | France . |

*Primary Examiner*—Stanley N. Gilreath
*Attorney, Agent, or Firm*—Parkhurst & Oliff

[57] ABSTRACT

This invention relates to a device (mandrel) serving as element for maintaining a cylindrical support tube around which yarn is wound. It is constituted by two elementary sleeves, mounted opposite each other on the drive shaft, said sleeves comprising peripheral fingers regularly spaced with respect to one another, the fingers of one sleeve abutting against the surface included between the fingers of the other sleeve. At least one of the elementary sleeves is mounted free in translation on the drive shaft and thrust means tend to maintain the two sleeves in spaced apart relationship with respect to each other, with the result that the ends of the fingers tend to move radially outward with respect to the axis of the mandrel and to firmly fix the cylindrical support tube disposed therearound.

4 Claims, 3 Drawing Sheets

DEVICE FOR POSITIONING AND HOLDING A YARN SUPPORT TUBE DURING AN OPERATION OF UNWINDING OR WINDING

The present invention relates to an improved device for positioning and holding a yarn support tube during an operation of unwinding or winding, during which said support (tube) is driven in rotation.

In the following specification, the invention will be described for a device, which will be designated by the term "expansible mandrel", used during an unwinding operation during which the mandrel is driven in rotation by its shaft, but it is obvious that such a device may also be used during a winding operation.

Such expansible mandrels are used on numerous textile machines, such as twisting machines, doubling machines, stranding machines, . . . In view of the increase in production speed, the weight and diameter of the windings arising from spinning, it is imperative that the axes of the mandrel and of the yarn support tube be in perfect register and that these two elements be perfectly immobile with respect to each other both during operation and when the machine is started or stopped. Moreover, another equally important problem is that of the ease of positioning the support on the mandrel as well as the extraction thereof, which operation is sometimes disturbed by the fact that the support tubes are not always perfectly cylindrical, particularly when they are made of cardboard.

Various solutions have been proposed up to the present time to solve these problems.

One such solution, described in U.S. Pat. No. 3,356,309, consists in using a mandrel provided tangentially with two equal surfaces (plates) extending over the whole length of the mandrel, symmetrically with respect to its axis, so that, after the support bearing the yarn has been positioned on said mandrel, the longitudinal edges of these surfaces come, over the whole of their extent, into contact with the cylindrical surfaces of the support, thus ensuring perfect register of the axes of the two elements, mandrel and support.

However, during periods of intensive work, further, in particular to the vibrations of the installations, the untimely tensions sometimes suffered by the wound yarns, relative displacements of the support with respect to the mandrel may occur, either axially or angularly, or both.

This results in irregular windings and variations in density and/or in the characteristics of the yarn produced which may lead to defects during subsequent treatments or when the yarn is used.

Moreover, the edges of the surfaces deteriorate very rapidly.

Finally, such a solution is not adapted to the case of support tubes of large diameter which, up to the present time, may attain more than three hundred millimeters, as, in that case, the tube bears only on four edges and may tend to be crushed and/or to slide with respect to the edges.

French Patent No. 2572374 has recently proposed an improvement in such a type of mandrel, whereby there are provided on the periphery of said mandrel a plurality of flexible blades, parallel to one another, extending over the whole of its length and of which the free edges are applied against the interior of the yarn support tube.

When applied, this solution did not prove satisfactory either, the flexible edges tending to deteriorate rapidly.

The solution most currently used up to the present time for ensuring positioning and holding of a yarn support tube consists in disposing, on the surface of the mandrel, flat springs which present the well known drawbacks of being expensive to make and of requiring replacement when springs deteriorate rapidly. Furthermore, upon sudden accelerations, particularly when the machine is started up or stopped, there is still the problem of relative slide of the support tube with respect to the mandrel. Finally, as positioning is effected by force, it is sometimes difficult, if not impossible, to do this if the support tube is not perfectly cylindrical.

A novel type of mandrel of particularly simple design has now been found, and this is the subject matter of the present invention, which overcomes the drawbacks of the prior art devices and, furthermore, easily renders automatic the positioning and removal of the support tubes of the mandrel.

This invention therefore generally relates to a novel type of mandrel adapted to serve as element for maintaining a hollow cylindrical support tube around which yarn is wound, which may be used in particular for unwinding said yarn, said mandrel being mounted on a shaft enabling it to be driven in rotation, and it is characterized in that:

the mandrel is constituted by two elementary sleeves, mounted opposite each other on the drive shaft, said sleeves comprising peripheral fingers regularly spaced with respect to one another, the fingers of one sleeve abutting against the surface included between the fingers of the other sleeve, at least one of the elementary sleeves being mounted free in translation on the drive shaft and the assembly is subjected to the action of thrust means tending to maintain the two sleeves in spaced apart relationship with respect to each other, with the result that the ends of the fingers tend to move radially outward with respect to the axis of the mandrel and to firmly fix the cylindrical support tube disposed around said mandrel.

Preferably, according to the invention:

the two elementary sleeves are identical except that the ends of the fingers of one of the sleeves comprise stops for the yarn support tube;

the elementary sleeves are made by moulding plastics material;

means tending to maintain the two elementary sleeves in spaced apart relationship with respect to each other are constituted by a spring.

The invention will be more readily understood on reading the following description with reference to the accompanying drawings, in which.

Figure 1:
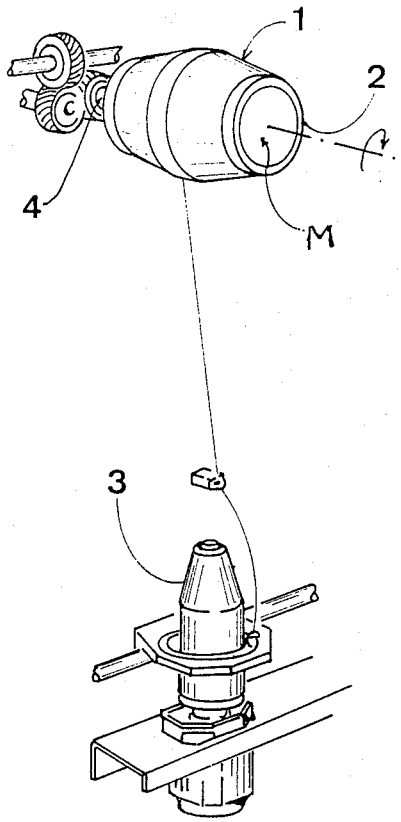
FIG. 1 is a schematic view in perspective of a work position of a twister necessitating a mandrel according to the invention.

Referring now to the drawings, FIG. 1 illustrates in perspective a work position of a twister in which a yarn winding 1 formed on a support tube 2, for example made of cardboard, must be unwound to be rewound on a ring and traveller spindle 3 enabling a twist to be communicated thereto. To this end, the yarn winding 1 is mounted on a support mandrel according to the invention, which will be seen in greater detail in the following description, said mandrel being driven in rotation by a drive shaft controlled by any appropriate means (for example a gear motor).

Figure 2:
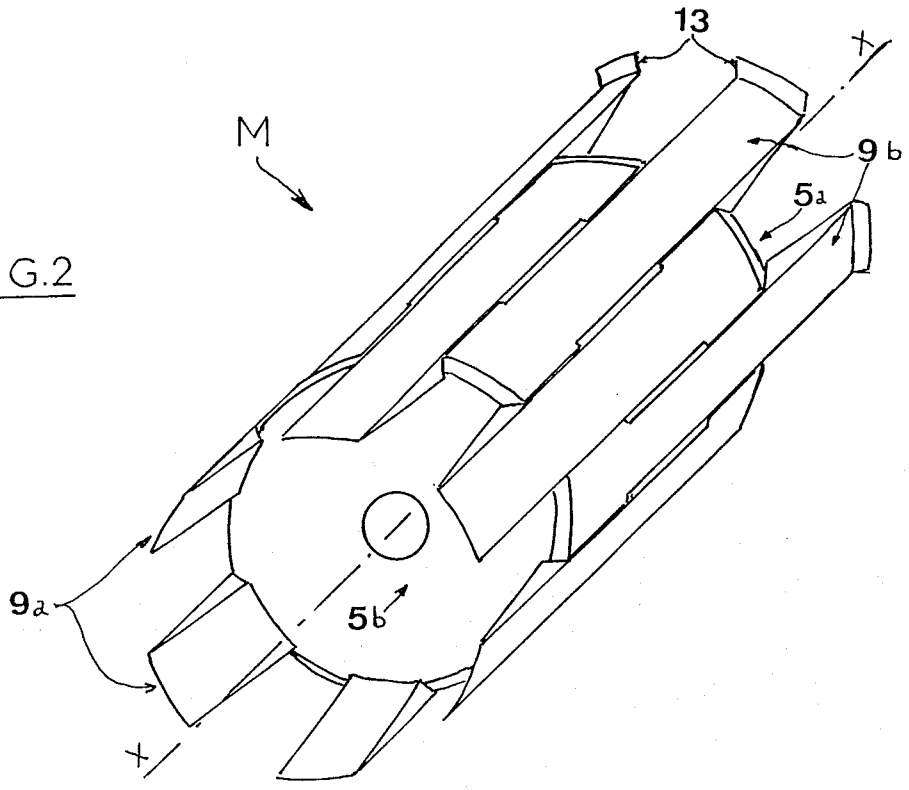
FIG. 2 is a schematic view in perspective of such a mandrel.
Figure 3:
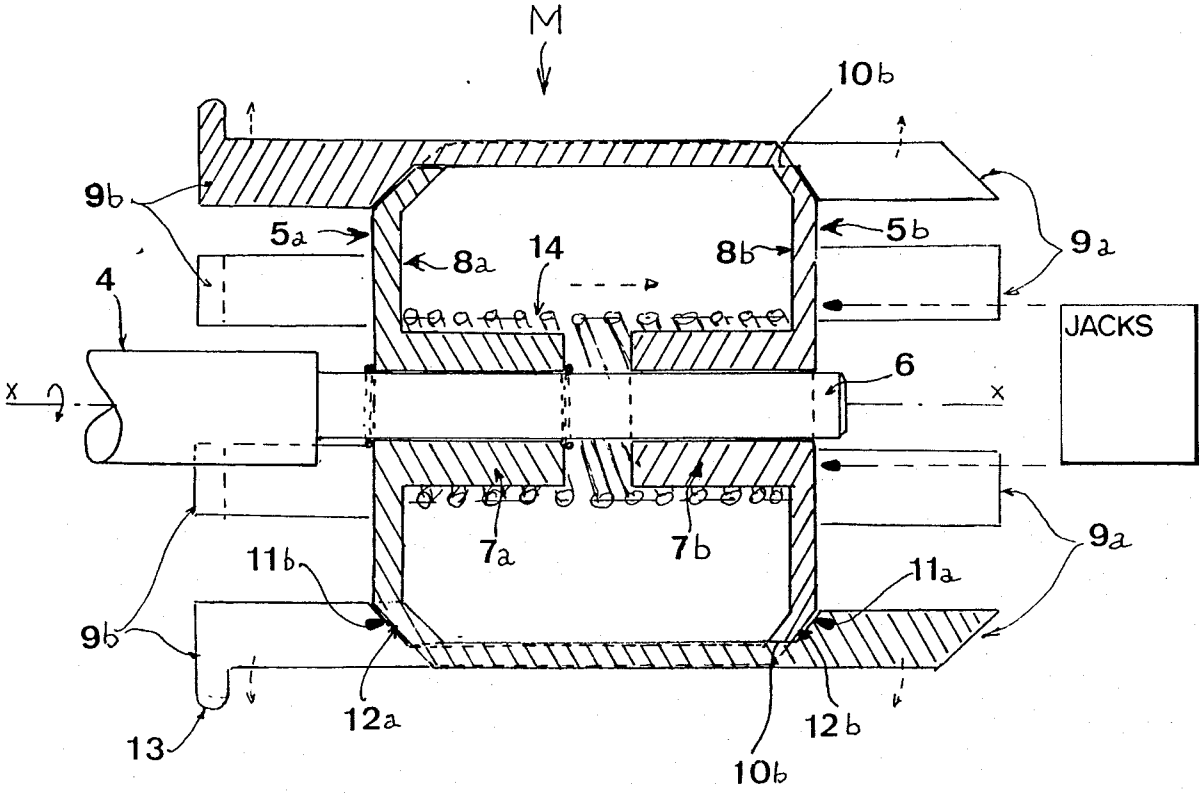
FIG. 3 is a section of a mandrel according to the invention along its longitudinal plane of symmetry.

In order to allow easy positioning and removal of the yarn support tube around mandrel M, as well as a centering and efficient immobilization of this tube during operation, said mandrel M is constituted, according to the invention, as shown in FIGS. 2 and 3, by two elementary sleeves 5*a*, 5*b*, mounted opposite each other at the end 6 of the drive shaft 4. These two sleeves 5*a*, 5*b* are made of moulded plastics material, from identical pieces and, in the following description, the same references with indices a and b added thereto will be used to designate the same elements which characterize the structure thereof.

The two sleeves 5*a* and 5*b* comprise a hub 7*a*, 7*b* enabling them to be mounted on the end 6 of the drive shaft 4, a bottom 8*a*, 8*b* and a plurality of peripheral fingers 9*a*, 9*b*. The sleeves 5*a*, 5*b* are mounted in opposition at the end 6 of the shaft 4, with the result that the peripheral fingers 9*a*, 9*b* are imbricated in one another and abut against the zone of join between the fingers of the opposite sleeve. In other words, the fingers 9*a* abut against the zone of join 10*b* formed between the fingers 9*b* of the sleeve 5*b* and vice versa for the fingers 9*b*. One of the sleeves, 5*a* for example, is mounted fixed on the end 6 of the drive shaft 4 whilst the other sleeve, 5*b* in the present case, is mounted free in translation. A spring 14 is applied between the inner faces of the bottoms 8*a* and 8*b* and tends to maintain the two sleeves normally in spaced apart relationship, with the result that the stops 11*a*, 11*b* provided on the lower face of each of the fingers 9*a*, 9*b* abut against the ramps 12*a*, 12*b* provided against the bottoms 8*a*, 8*b*, this tending to move the ends of said fingers radially outward with respect to axis XX of the mandrel. In normal operation, the yarn support tube is therefore perfectly maintained and centred around the mandrel M. When it is desired to position or remove the support tube, the two sleeves 5*a*, 5*b* are brought into the position shown in FIGS. 2 and 3, i.e. the sliding sleeve 5*b* is pushed, for example by means of jacks, so as to compress the inner spring 14 so that the ends of the flexible fingers are no longer subjected to the action of the ramps and tend to resume their initial position parallel to axis XX of the mandrel.

In order to correctly position the yarn support 2, the ends of the fingers 9*b* of sleeve 5*b* comprise peripheral stops 13, whilst these stops have been removed, by machining, at the ends of the fingers of sleeve 5*a*.

Such a mandrel, of particularly simple design, is extremely efficient, easy to maintain and to assemble and, furthermore, allows automatic self-centering when the yarn support tubes are placed in position. The dimensions of the mandrel are, of course, determined as a function of the diameter and length of the support tubes. Moreover, if such a mandrel is particularly adapted to equip the unwinding part of a doubling-twisting machine, it may similarly be envisaged to ensure holding of the support tubes for unwinding.

What is claimed is:

1. A mandrel adapted to serve as an element for maintaining a hollow cylindrical support tube around which yarn is wound, which may be used in particular for unwinding said yarn, comprising:

two elementary sleeves, mounted on a drive shaft in an axially spaced apart relationship, said sleeves comprising peripheral fingers regularly spaced with respect to one another, the fingers of one sleeve extending in an opposite axial direction relative to the fingers of the other sleeve and abutting against a cam surface included between the fingers of the other sleeve, at least one of the elementary sleeves being mounted free in translation on the drive shaft; and thrust means for maintaining the two sleeves in spaced apart relationship with respect to each other, said thrust means urging the elementary sleeves in opposite axial directions relative to said mandrel to move the fingers of one sleeve against the cam surface of the other sleeve so that the ends of the fingers tend to move radially outward with respect to the axis of the mandrel and firmly fix the cylindrical support tube disposed around said mandrel.

2. The mandrel of claim 1, wherein the ends of the fingers of one of the sleeves comprise stops for the yarn support tube.

3. The mandrel of claim 1, wherein the elementary sleeves are made of plastics material.

4. The mandrel of claim 1, wherein said thrust means tending to maintain the two elementary sleeves in spaced apart relationship with respect to each other are constituted by a spring.

* * * * *